US006044555A

United States Patent [19]

Jacob et al.

[11] Patent Number: 6,044,555

[45] Date of Patent: Apr. 4, 2000

[54] METHOD FOR PRODUCING FULLY DENSE POWDERED METAL HELICAL GEAR

[75] Inventors: Nedward A. Jacob, St. Marys; Jerome E. Muroski, Johnsonburg, both of Pa.

[73] Assignee: Keystone Powered Metal Company, St. Mary's, Pa.

[21] Appl. No.: 09/072,146

[22] Filed: May 4, 1998

[51] Int. Cl.[7] ..... B21H 1/04

[52] U.S. Cl. ..... 29/893.34; 72/377

[58] Field of Search ..... 29/893.34; 72/377

[56] References Cited

U.S. PATENT DOCUMENTS

| | | | |
|---|---|---|---|
| 3,752,003 | 8/1973 | Dunn et al. | 74/434 |
| 3,772,935 | 11/1973 | Dunn et al. | 74/434 |
| 3,842,646 | 10/1974 | Kuhn . | |
| 3,867,751 | 2/1975 | Connell et al. | 72/102 |
| 3,891,367 | 6/1975 | Signora . | |
| 4,054,449 | 10/1977 | Dunn et al. | 75/208 R |
| 4,145,798 | 3/1979 | Sarnes . | |
| 4,165,243 | 8/1979 | Sarnes et al. . | |
| 4,470,953 | 9/1984 | Bruce . | |
| 4,585,619 | 4/1986 | Westin . | |
| 4,710,345 | 12/1987 | Doi et al. . | |
| 4,712,411 | 12/1987 | Goodwin . | |
| 4,770,572 | 9/1988 | Ohkawa et al. . | |
| 4,920,009 | 4/1990 | Lee et al. . | |
| 5,390,414 | 2/1995 | Lisowsky . | |

FOREIGN PATENT DOCUMENTS

| | | |
|---|---|---|
| 0 528 761 | 2/1993 | European Pat. Off. . |
| 2 607 040 | 5/1988 | France . |
| WO 98/16338 | 4/1998 | WIPO . |

*Primary Examiner*—P. W. Echols
*Attorney, Agent, or Firm*—Buchanan Ingersoll, P.C.

[57] ABSTRACT

A method for producing a fully dense powdered metal helical gear can include the steps of placing powdered metal in a preform die wherein it can be compacted axially by rotating punches to create a helical gear preform. Next the preform can be sintered. The preform can then be heated to an appropriate temperature and inserted into a hot forming die wherein it can be impacted axially by a rotating punches to fully densify the helical gear preform. Next the densified helical gear can be inserted in a burnishing die where it can be forced through a helical profiled die cavity to impart more precise external dimensions. Process temperatures and impact forces can vary depending on the properties of the powdered metal and desired characteristics of the finished part. Secondary treatments, such as rolling, shaving, heat treating, chining to length and inner diameter sizing can be subsequently performed.

7 Claims, 5 Drawing Sheets

METHOD FOR PRODUCING FULLY DENSE POWDERED METAL HELICAL GEAR

BACKGROUND

The present invention relates to a method for producing a powdered metal gear, and more particularly, to a method for producing a fully dense powdered metal helical gear.

The production of powdered metal articles, including gears, is well-known in the art. One type of powdered metal is selected or different types can be blended together. The powder is disposed in a mold cavity which may be a simple cylindrical preform or may have the profile of the finished product. Next, pressure is applied to create the preform. The preform can then be removed and sintered to produce the part. Where a cylindrical preform is used the preform is placed in another mold and more pressure is applied to form an article having the desired shape. This new preform can then be sintered.

Apparatus for forming helical gears are also known in the art wherein portions of the mold rotate when the preform is impacted to cause the preform to take the shape of the helical gear. For example, such an apparatus having rotating parts for producing powdered metal helical gears is disclosed in U.S. Pat. No. 3,891,367 to Signora. In Signora, the preform has the shape of the actual helical gear to be produced, in contrast to first forming a cylindrical preform which is later transformed into a helical gear.

Goodwin, in U.S. Pat. No. 4,712,411, discloses an apparatus for making a fully dense powdered metal helical gear. Goodwin generally describes producing the helical gear by first creating a cylindrical preform by sintering. The cylindrical preform is then placed in a forming mold wherein the mold cavity has the specific geometry of the helical gear. The preform is then heated and placed in the forming mold where it is axially impacted to both impact the helical toothed shape and also to densify the gear. A disadvantage of the method employed by Goodwin can be that when the preform is impacted a lot of flashing can result as the preform is forced into the shape of the helical gear. Consequently, additional finishing processes can be required to clean up the gear before it is acceptable to a customer.

Both Signora and Goodwin utilize mechanically created pressure to form the gear. However, it is also known to utilize isostatic pressure to form a helical powdered metal gear. For example, Lisowsky, U.S. Pat. No. 5,390,414, discloses a method of manufacturing a helical gear from powered metal using hot and cold isostatic pressure. Like Goodwin, Lisowsky employs a first mold to create a simple cylindrical preform having only the general geometry of the intended gear. A second mold is provided having the specific geometry of the gear and is slightly larger than the preform. The preform is placed inside the second mold, wherein additional powdered metal is provided around the preform to produce a second preform having a helical gear shape. Cold isostatic pressure is used to create both the simple preform and the helical gear preform. After the helical gear preform is made, hot isostatic pressure and/or sintering is employed to create the densified helical gear.

Isostatic pressure forming can generally involve placing a gear preform within a mold cavity having the specific geometry of the helical gear. A rubber bladder is inserted through a center bore in the gear. Fluid is pumped into the rubber bladder at extremely high pressures thus radially expanding the preform against the walls of the mold cavity and causing it to take on the helical gear shape. A disadvantage with isostatic forming is that it can take much longer for the process to fully densify the gear. In hot forming, enormous amounts of pressure can be generated in an instant by impacting the gear axially. In contrast, with isostatic pressure it can take time to build up the pressure and it may be preferable to keep the gear subjected to the pressure for a relatively long time to ensure that the preform fully takes on the specific geometry of the helical gear. Also, for example, obtaining accurate dimensions in the axial direction can be difficult when using isostatic pressure forming. There is generally no mold abutting the axial ends of the gear because the bladder must be inserted through a center bore in the gear. Thus, the axial dimension can be difficult to accurately control. Consequently, more finishing steps can be required to obtain final dimensions having the desired accuracy. Moreover, besides controlling the length of the gear, the lack of control over the axial dimension can also make it more difficult to fully densify the gear. This is because without control over the axial dimension, the gear can experience some undesirable axial expansion in addition to the radial expansion. Consequently, instead of compacting all of the molecules of the gear together, as would occur if both the radial and axial dimensions were controlled, the gear lengthens somewhat which results in a longer and less dense gear.

Accordingly, there is a need for a method of producing fully dense powdered metal helical gears which can eliminate the step of creating a simple cylindrical preform and which can control both the axial and radial dimensions of the gear to create a helical gear with greater density, more accurate axial dimensions and less flashing. Consequently, less finishing steps can be necessary to obtain a superior final product.

SUMMARY

A method for producing a fully dense powdered metal helical gear according to the invention can include placing a desired blend of powdered metal into a first, preform die. Preferably, the preform dies can have the specific shape and approximate dimensions of the desired finished article, for example, a helical gear. The powdered metal can then be axially compacted by rotating punches with enough force to generate sufficient pressure to create a helical gear preform.

Next, the helical gear preform is placed in a furnace where it is sintered. The sintered preform can then be lubricated, heated, and delivered to a hot forming press. In the hot forming press the sintered preform can be axially impacted by punches with sufficient force to generate enough pressure to fully densify the gear. The hot forming press can have punches which rotate as they impact the sintered preform.

After the hot forming process the densified helical gear can be slow cooled to room temperature. From the slow cooling operation, the hot forming lubricant can be removed from the densified helical gear by grit blasting. From grit blasting, the densified helical gear can be lubricated and delivered to a burnishing press. In the burnishing press the densified helical gear can be forced through a helical profiled die cavity to impart the more precise dimensions desired of the final product. Additional finishing operations, for example rolling, shaving, heat-treating, machining to length and inner bore diameter grinding can be performed if desired.

Other details, objects, and advantages of the invention will become apparent from the following detailed description and the accompanying drawing figures of certain embodiments thereof.

BRIEF DESCRIPTION OF THE DRAWINGS

A more complete understanding of the invention can be obtained by considering the following detailed description in conjunction with the accompanying drawings, wherein.

DETAILED DESCRIPTION OF CERTAIN PREFERRED EMBODIMENTS

Figure 1:
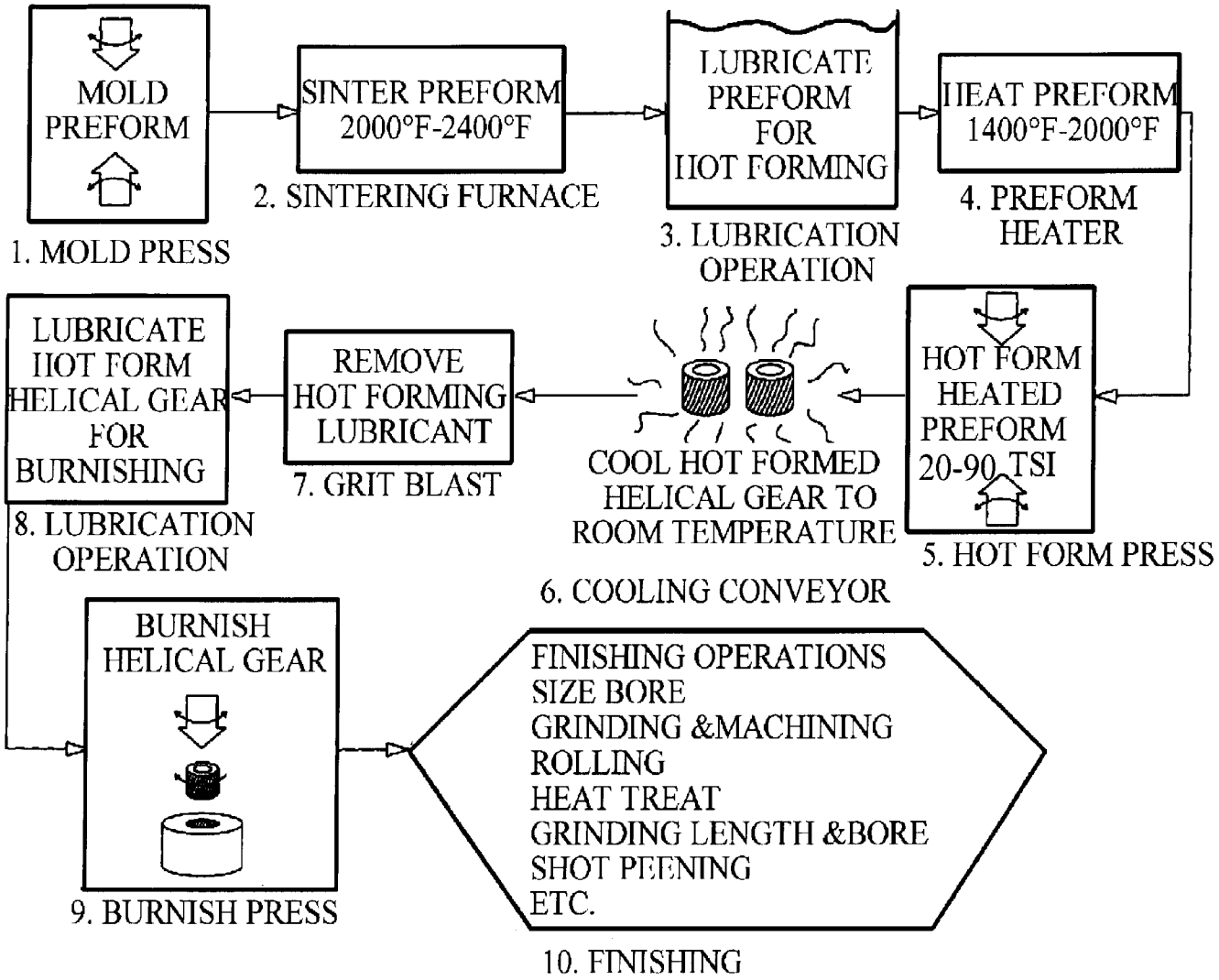
FIG. 1 is a flow diagram showing the general steps of a method according the invention.
Figure 2:
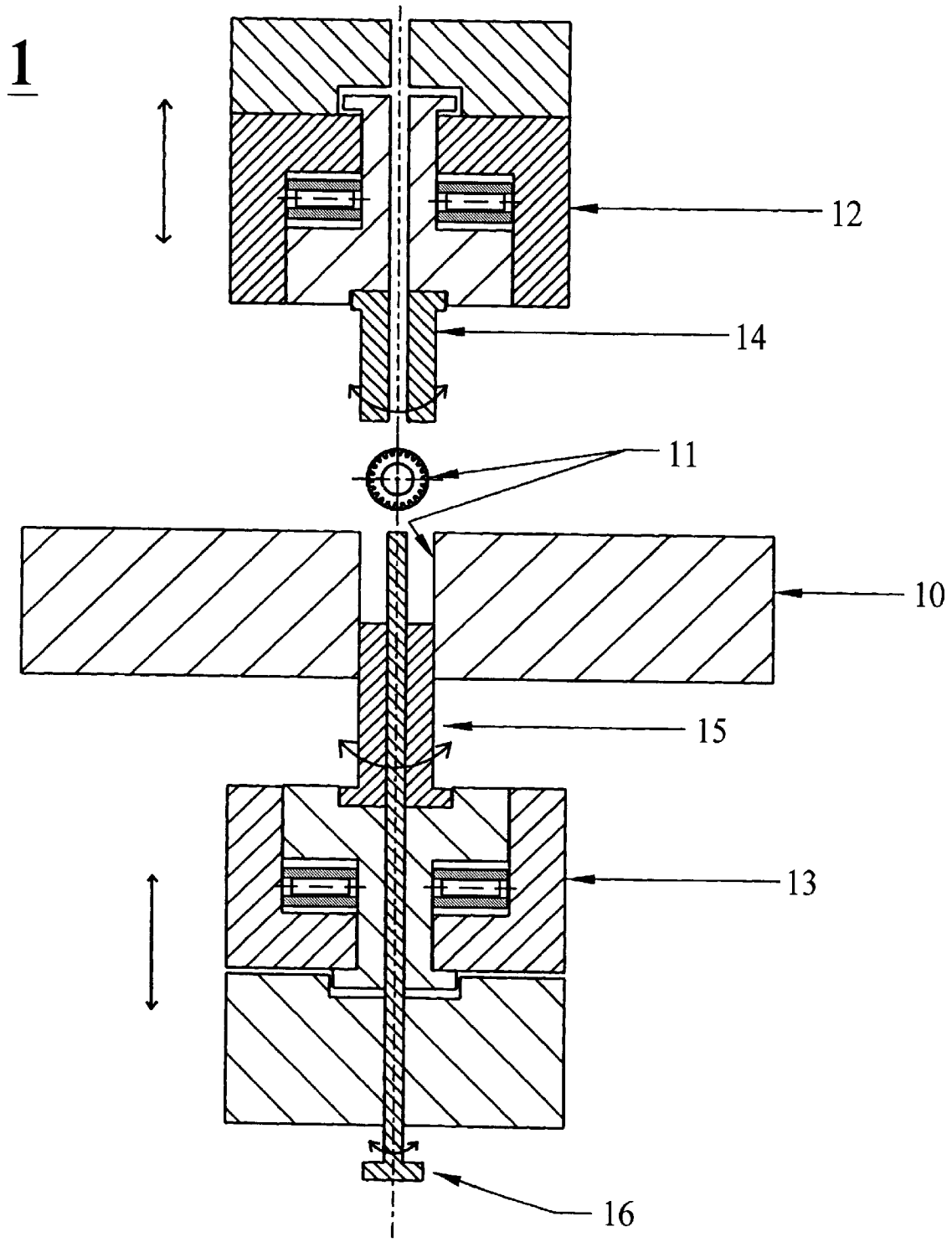
FIG. 2 is a simplified drawing of preform tools.

Referring now to the drawing figures wherein like reference numbers refer to similar parts throughout the several views, a method for producing a fully dense powdered metal helical gear is schematically shown, FIG. 1. The powdered metal from which the gear is to be formed is selected and blended. The powder is delivered to the mold press 1 and the powder is then placed into a preform die 10 portion of the mold press 1, as shown in FIG. 2. Preferably, the preform die 10 has a die cavity 11 having the specific geometry of the desired article, for example, a helical gear. The powdered metal can then be axially compacted with enough force to generate sufficient pressure to create a helical gear preform having the specific geometry of the desired final product. Generally, about 40 tons per square inch (tsi) is applied to create the helical gear preform. However, this pressure may vary from 20 to 50 tsi depending on the metal powder and the article to be formed. The preform press 1 preferably includes a die 10, an upper portion 12 and a lower portion 13. The upper portion 12 has a punch 14 which has an external geometry to match the die 10. The punch 14 can rotate corresponding to the helical twist of the gear as the punch 14 enters the die 10 to compact the powdered metal to create the helical gear preform. Such rotating die members are disclosed in the Signora patent referred to previously and the teachings of Signora relating thereto are hereby incorporated herein by reference. The lower portion 13 of the preform tools can have a punch 15 which has an external geometry to match the die 10. The punch 15 can rotate when it ejects the helical gear preform from the preform die 10. The lower portion 13 of the preform tools can have a core pin 16 which can form the bore 45 of the helical preform. The core pin 16 can rotate during powder compaction and preform ejection from the die 10. A helical gear preform 40 produced as described above can have the appearance shown in FIG. 4*a*.

Figure 3:
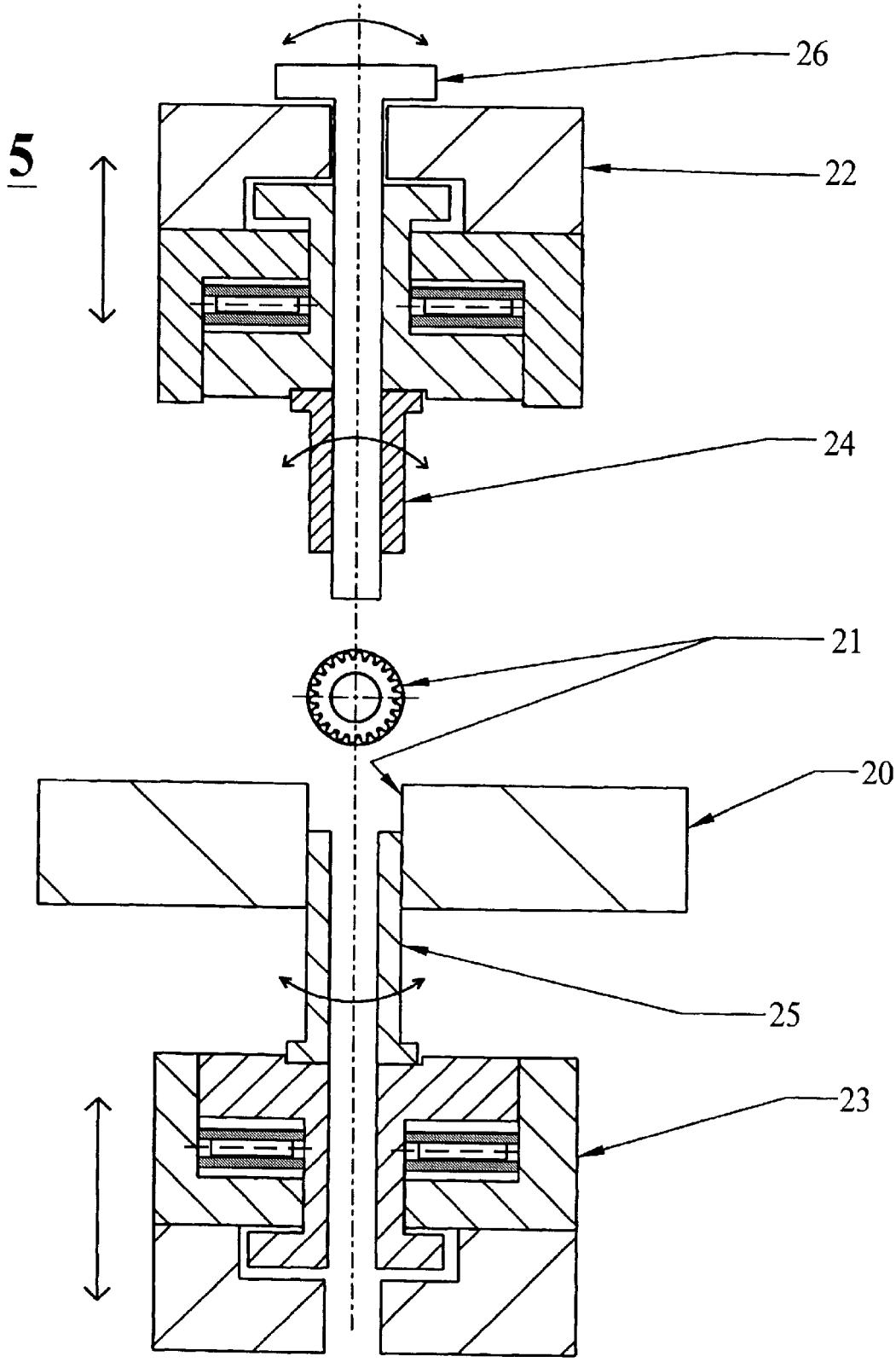
FIG. 3 is a simplified drawing of hot forming tools.

After ejection from the perform die 10, the helical gear preform 40 is placed in a furnace 2 wherein it is sintered. The sintering temperature is generally about 2070° F., but can vary from 2000° F. to 2400° F. depending on the type of powder and the part. From the furnace 2, the sintered helical gear preform 40 is cooled to room temperature. The sintered preform 40 is delivered to a lubrication operation 3 where the sintered preform is coated with a high temperature lubricant. The lubricated helical preform 40 is delivered to a preform heater 4 where the preform is heated to, for example, about 1850° F. Preferably, the sintered preform 40 is inductively heated. However, radiant heating and convection heating can also be used. The temperature can vary between 1400° F. and 2100° F. depending on the type of powder and the part. From the preform heater 4 the heated sintered preform 40 is then sent to a hot form press 5, shown best in FIG. 3. The hot forming press 5 includes a hot forming die 20 which is preferably maintained at a controlled temperature which can be typically about 600° F. When the heated preform 40 is placed in the hot forming die 20 shown in FIG. 3 it is instantly axially impacted with sufficient force to generate enough pressure to fully densify the sintered helical gear preform 40. The pressure is usually about 40 tsi in this step, but can vary from 20 tsi to 90 tsi for different types of powders and parts. Like the preform press 1, the hot forming press 5 has a die 20 with a helical profiled cavity 21, an upper portion 22 and a lower portion 23. The upper portion 22 has a punch 24 that impacts the sintered preform. The punch 24 has an external geometry to match the die 20 cavity. Preferably the punch 24 rotates corresponding to the helical twist of the gear as it impacts the sintered preform 40. The upper portion 22 can have a core pin 26 which can support and form the bore 45 of the preform 40 in the hot forming process. The core pin 26 can rotate during the hot forming process. Immediately after impact, the densified helical gear is ejected from the die cavity 21 by the punch 25. Preferably, the punch 25 rotates as the densified gear is ejected. The entire hot forming process may have a duration of, for example, only about one second, or less. Alternatively, a hot preform can be taken from the sintering furnace 2, and hot formed in a lubricated hot forming die 20 as previously described. A densified helical gear 43 produced according to the preceding preforming and hot forming steps can have the appearance shown in FIG. 4*b*. As can be seen from FIGS. 4*a* and 4*b*, the densified gear 43 has a shorter axial length than the sintered preform helical gear 40. However, both gears have the same weight. The shorter helical gear 43 simply has greater density.

The density of the helical gear preform 40 can be varied at the initial preforming process in the preform die 10. The average density of the preform 40 is typically about 6.8 grams per cubic centimeter (g/cc), but can vary from 6.2 to 7.2 g/cc. The weight of the preform 40 can be critical and should be closely controlled.

The final density of the helical gear 43 can be dependent on the axial impacting force applied to the heated preform 40 in the hot forming die 20. The final density of the helical gear 43 is typically about 7.82 g/cc, but can vary from 7.5 to 7.85 g/cc. Maximum density generally corresponds to the minimum length of the densified helical gear for a given weight.

Figure 5:
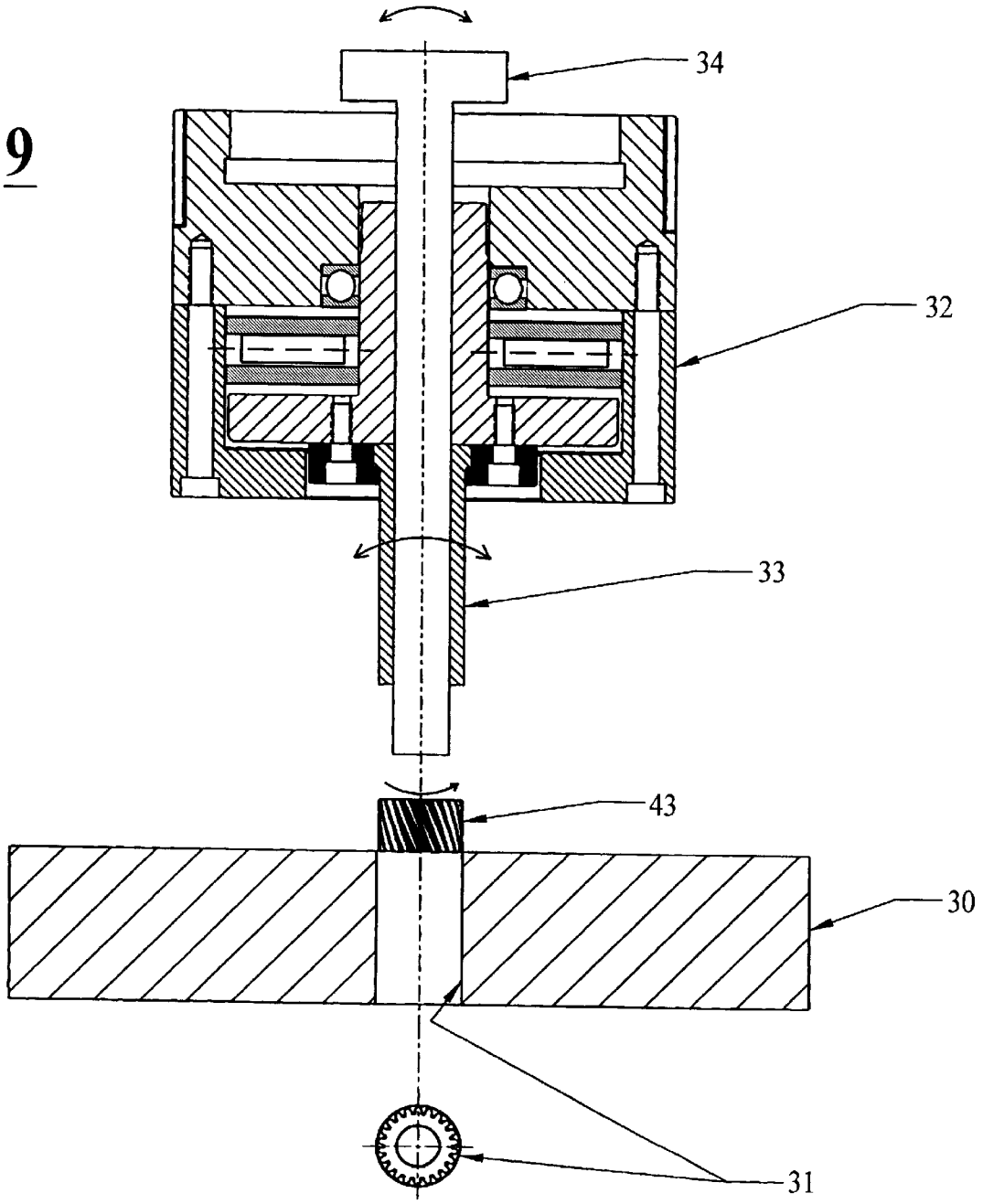
FIG. 5 is a simplified drawing of burnishing tools.

After ejection from the hot forming die 20, the densified helical gear 43 is delivered to the cooling conveyor 6 where it can be cooled to room temperature. From the cooling conveyor 6 the densified helical gear 43 is lubricated 8 and delivered to a third, burnishing press 9 where it is placed in a burnishing die 30 portion of the burnishing press 9, as shown in FIG. 5. The burnishing die 30 has a helical profiled cavity 31 and an upper portion 32. The upper portion 32 has a punch 33 and a core pin. The punch 33 can be round or can have an external geometry to match the die cavity 31. The upper portion 32 can have a core pin 34 that can support the bore 45 of the densified helical gear 43 in burnishing. In the burnishing press 9, the densified helical gear 43 is forced through the helical profiled die cavity 31 by the punch 33. The profiled die cavity 31 has the exact dimensions which are desired to be embodied by the finished fully dense helical gear. In this process, the densified helical gear 43 rotates as it is pushed through the die cavity 31. The punch 33 and the core pin 34 can rotate with the densified helical gear 43 as it is pushed through the burnishing die 30. The burnishing step "trues up" the tooth profile of the densified helical gear 43. The more precise external dimensions of the helical teeth are imparted as the gear is pushed through the die 30. At this stage the densified helical gear 43 has not yet been heat treated, i.e., hardened, and thus is still somewhat malleable. Consequently, the gear can be better conformed to the exact dimensions of the die cavity 31 as it is forced therethrough. Prior to the burnishing step the densified helical gear 43 may only be a class 3 or 4. However, after burnishing, the gear 43 can have much more precise external dimensions and might be a class 7 through 10. Such gears are classified, in one respect, according to the precision with which the external dimensions are maintained to the specified dimensions during production. On a scale of 1 to 10, a class 1 gear would have external dimensions with the least degree of precision, whereas a class 10 gear would have external dimensions with the highest degree of precision.

Additional, final finishing treatments can be performed after burnishing if desired, for example, the densified helical gear 43 is hardened by heat treating. Also, the densified helical gear 43 can be machined or ground to desired axial lengths. Further, the center bore 43 can be machined or ground to a desired diameter. Further, the densified helical gear can be shaved and/or rolled to obtain an even more precise tooth profile.

Figure 4B:
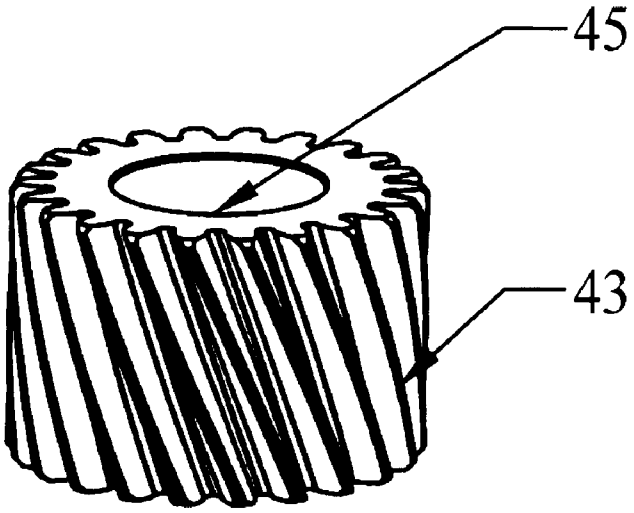
FIG. 4*b* shows a fully dense powdered metal helical gear produced using a method according to the invention.
Figure 4A:
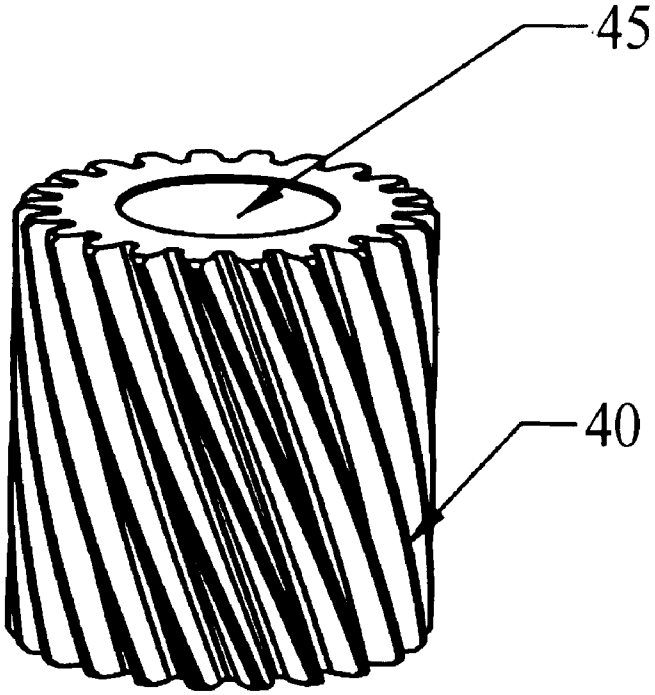
FIG. 4*a* shows a powdered metal helical gear preform produced using conventional methods.

Although the helical gears 40, 43 illustrated in FIGS. 4*a* and 4*b* are shown having a center bore 45, they can also be produced as a solid piece. Moreover, the method described above could also be employed to create a helical gear having a shaft portion or other such differently shaped portions as permitted by multilevel molding or differently designed die cavities, as is known to those skilled in the art.

Accordingly, although certain embodiments of the invention have been described in detail, it will be appreciated by those skilled in the art that various modifications to those details could be developed in light of the overall teaching of the disclosure. As such, the particular embodiments disclosed herein are intended to be illustrative only and not limited to the scope of the invention which should be awarded the full breadth of the following claims and any and all embodiments thereof.

What is claimed is:

1. A method for making a fully dense powdered metal helical gear comprising:

a. providing powdered metal in a preform mold having a rotating die member and a helical gear shaped mold cavity;

b. axially impacting the powdered metal with the rotating die member to create a helical gear preform;

c. sintering the helical gear preform;

d. placing the sintered helical gear preform in a hot forming mold having a rotating die member and a helical gear shaped mold cavity; and e. axially impacting the heated helical gear preform with the rotating die member to create a fully dense helical gear.

2. The method of claim 1 further comprising lubricating the helical shaped die cavity in the hot forming die prior to step e.

3. The method of claim 1 further comprising heating the sintered helical gear preform prior to step e.

4. The method of claim 3 further comprising lubricating the heated sintered helical gear preform prior to step e.

5. The method of claim 1 further comprising:

g. placing the fully dense helical gear in a burnishing die having a helical profiled die cavity; and h. pushing the densified helical gear through the helical profiled die cavity.

6. The method of claim 5 further comprising lubricating the fully dense helical gear prior to step g.

7. The method of claim 5 further comprising cooling the fully dense helical gear prior to step g.

* * * * *